US008803427B1

(12) United States Patent
Sun et al.

(10) Patent No.: US 8,803,427 B1
(45) Date of Patent: Aug. 12, 2014

(54) LED PACKAGE STRUCTURE

(71) Applicant: National Central University, Taoyuan County (TW)

(72) Inventors: Ching-Cherng Sun, Taoyuan County (TW); Yu-Yu Chang, Kaohsiung (TW); Ching-Yi Chen, New Taipei (TW)

(73) Assignee: National Central University, Taoyuan County (TW)

( * ) Notice: Subject to any disclaimer, the term of this patent is extended or adjusted under 35 U.S.C. 154(b) by 0 days.

(21) Appl. No.: 13/892,525

(22) Filed: May 13, 2013

(51) Int. Cl.
*H05B 37/02* (2006.01)
*F21V 7/00* (2006.01)

(52) U.S. Cl.
USPC ..... 315/152; 362/235

(58) Field of Classification Search
USPC ..... 315/152, 291, 294, 297, 299, 307, 308, 315/312; 362/231, 235, 276, 294, 249.02, 362/800
See application file for complete search history.

(56) References Cited

U.S. PATENT DOCUMENTS

2013/0056765 A1* 3/2013 Thompson et al. ..... 257/88

* cited by examiner

*Primary Examiner* — Jimmy Vu
(74) *Attorney, Agent, or Firm* — Rosenberg, Klein & Lee

(57) ABSTRACT

A LED package structure includes a base; at least one main light chip assembled to the base; a plurality of sub light chips assembled to the base; a wavelength shifter assembled to the base, the wavelength shifter located above each main light chip and each sub light chip, the wavelength shifter configured to shift a wavelength of each light beam from each main light chip; an outer lens assembled to the base and located above the wavelength shifter, so as to package each main light chip, each sub light chip and the wavelength shifter, the outer lens improving a light extraction efficiency of the light beams; and a controlling member electrically connected to each main light chip and each sub light chip, the controlling member configured to control luminance of each main light chip and luminance of each sub light chip.

7 Claims, 6 Drawing Sheets

LED PACKAGE STRUCTURE

BACKGROUND OF THE INVENTION

1. Field of the Invention

The present invention relates to a package structure, and more particularly to a LED package structure.

2. Description of Related Art

A conventional LED device comprises a base; a light chip electrically assembled to the base; an outer lens assembled to the base and located above the light chip, so as to package the light chip.

However, when the ambient environment is bright, the conventional LED device cannot drive the luminance of the light chip to decrease; when the ambient environment is dark, the conventional LED device cannot drive the luminance of the light chip to increase. Therefore, when the ambient environment is bright, a power consumption of the light chip cannot be decreased.

The present invention has arisen to mitigate and/or obviate the disadvantages of the conventional.

SUMMARY OF THE INVENTION

The main objective of the present invention is to provide an improved package structure.

To achieve the objective, a LED package structure comprises a base; at least one main light chip assembled to the base; a plurality of sub light chips assembled to the base; a wavelength shifter assembled to the base, the wavelength shifter located above each main light chip and each sub light chip, the wavelength shifter configured to shift a wavelength of each light beam from each main light chip; an outer lens assembled to the base and located above the wavelength shifter, so as to package each main light chip, each sub light chip and the wavelength shifter, the outer lens improving a light extraction efficiency of the light beams; and a controlling member electrically connected to each main light chip and each sub light chip, the controlling member configured to control luminance of each main light chip and luminance of each sub light chip according to an ambient environment. Wherein, the wavelength of each light beam from each main light chip is 350 nm to 470 nm; the wavelength of each light beam from each sub light chip is 480 nm to 570 nm; each main light chip is a blue LED; each sub light chip is a green LED; the wavelength of each light beam from each main light chip is 350 nm to 470 nm; the wavelength of each light beam from each sub light chip is 600 nm to 870 nm; each main light chip is a blue LED; each sub light chip is a red LED; the light beams from each main light chip are mixed with the light beams from each sub light chip; after the wavelength of each light beam from each main light chip is shifted by the wavelength shifter, a color temperature of the LED package structure is 5500K to 7000K; the wavelength shifter has a plurality of fluorescent powders; the fluorescent powders correspond to each main light chip; the controlling member has a sensing unit and an adjusting unit which is electrically connected to the sensing unit; the adjusting unit is electrically connected to each main light chip and each sub light chip; the sensing unit is configured to sense the ambient environment and send a signal to the adjusting unit, so as to drive the adjusting unit to control the luminance of each main light chip and the luminance of each sub light chip; each of the main light chip and the sub light chip is a watt-level chip.

Further benefits and advantages of the present invention will become apparent after a careful reading of the detailed description with appropriate reference to the accompanying drawings.

DETAILED DESCRIPTION OF THE INVENTION

Figure 1:
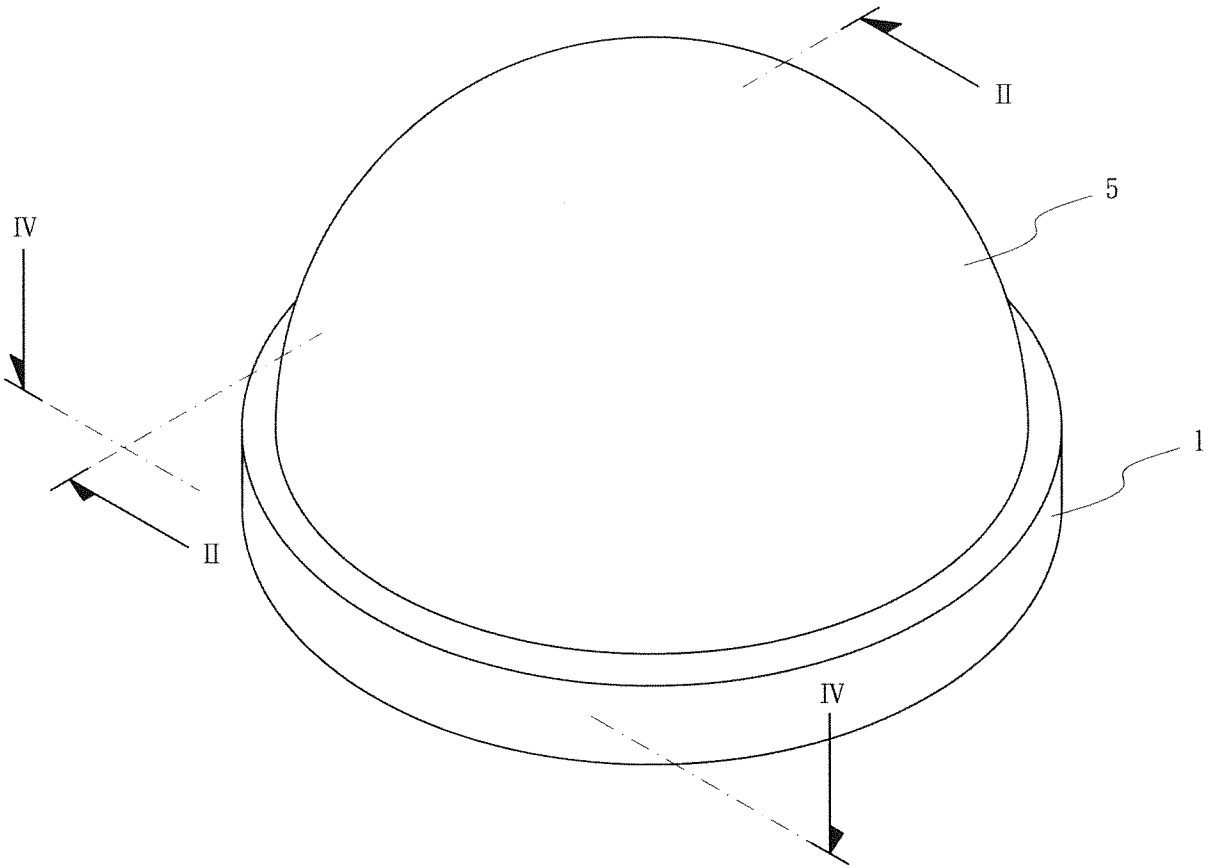
FIG. 1 is a perspective view of the present invention.
Figure 2:
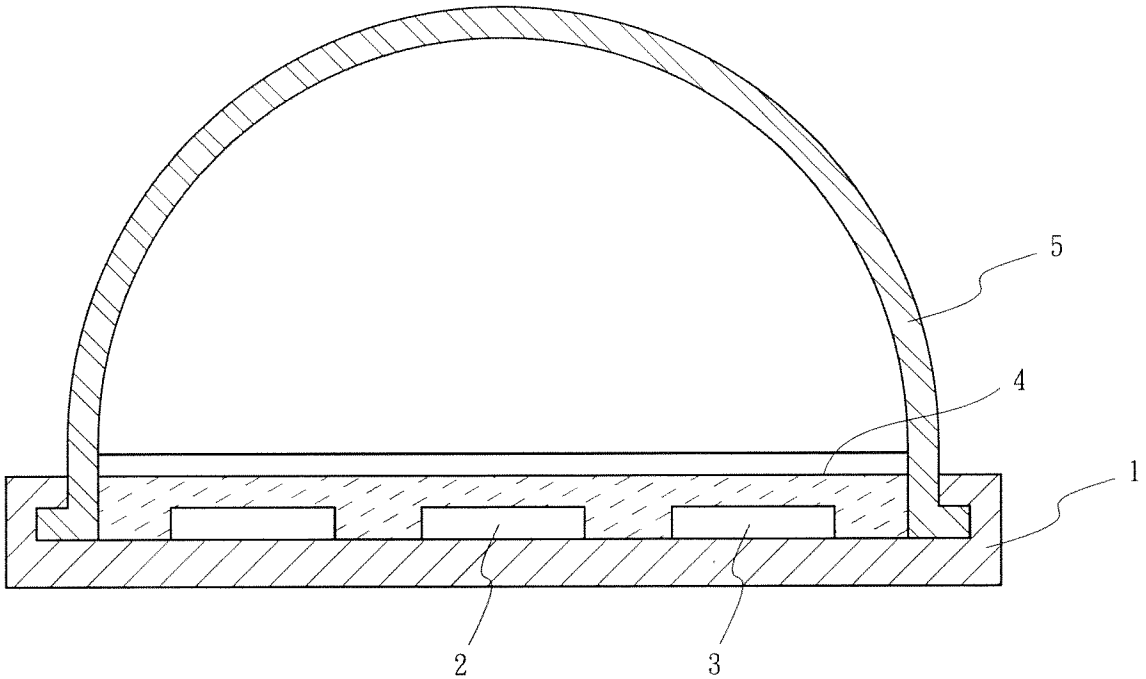
FIG. 2 is a cross-sectional view along a line II-II in FIG. 1.

Referring to FIGS. 1-6, a LED package structure in accordance with the present invention comprises a base 1, at least one main light chip 2, a plurality of sub light chips 3, a wavelength shifter 4, an outer lens 5 and a controlling member 6. Each main light chip 2 is assembled to the base 1 and is enclosed by a gel (the gel is made of silicone). Each sub light chip 3 is assembled to the base 1. The wavelength shifter 4 is assembled to the base 1. The wavelength shifter 4 is located above each main light chip 2 and each sub light chip 3. A wavelength of each light beam from each main light chip 2 is shifted by the wavelength shifter 4. The outer lens 5 is assembled to the base 1. The outer lens 5 is located above the wavelength shifter 4, so that each main light chip 2, each sub light chip 3 and the wavelength shifter 4 are packaged with the outer lens 5 and the base 1. When the light beams passes through the outer lens 5, the outer lens 5 improves a light extraction efficiency of the light beams. The controlling member 6 is electrically connected to each main light chip 2 and each sub light chip 3. The controlling member 6 is configured to control luminance of each main light chip 2 and luminance of each sub light chip 3.

Under this arrangement, the controlling member 6 controls the luminance of each main light chip 2 and the luminance of each sub light chip 3 according to an ambient environment. For example, when the ambient environment is bright, the controlling member 6 drives the luminance of each main light chip 2 and the luminance of each sub light chip 3 to decrease; when the ambient environment is dark, the controlling member 6 drives the luminance of each main light chip 2 and the luminance of each sub light chip 3 to increase. Therefore, when the ambient environment is bright, a power consumption of each light chip 2 or 3 is decreased because of the controlling member 6.

Figure 4:
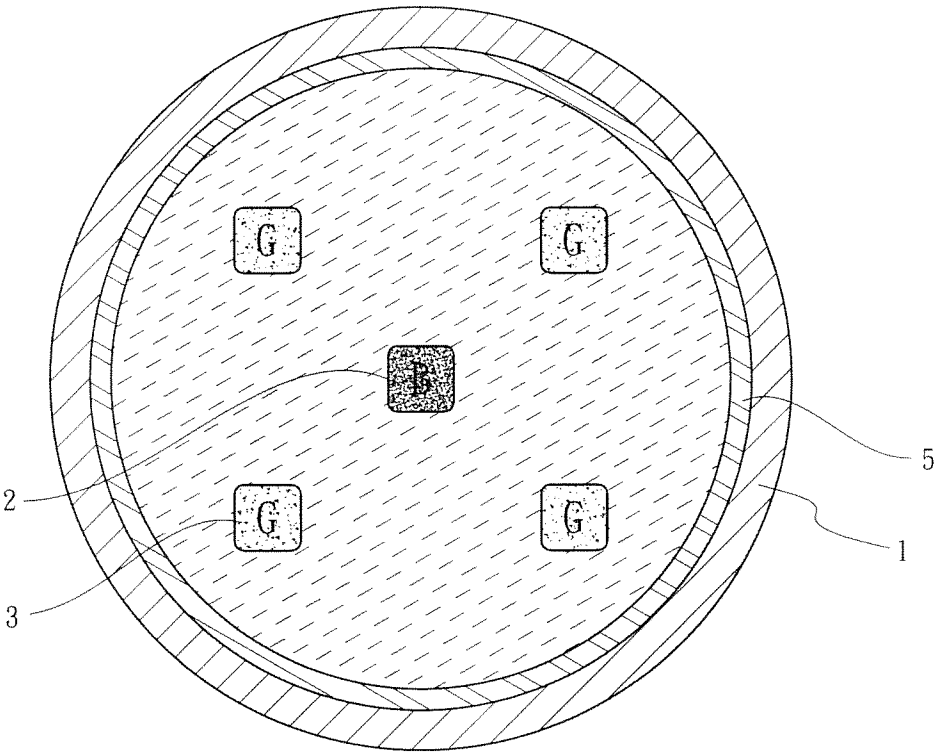
FIGS. 4-5 are cross-sectional views along a line IV-IV in FIG. 1.
Figure 5:
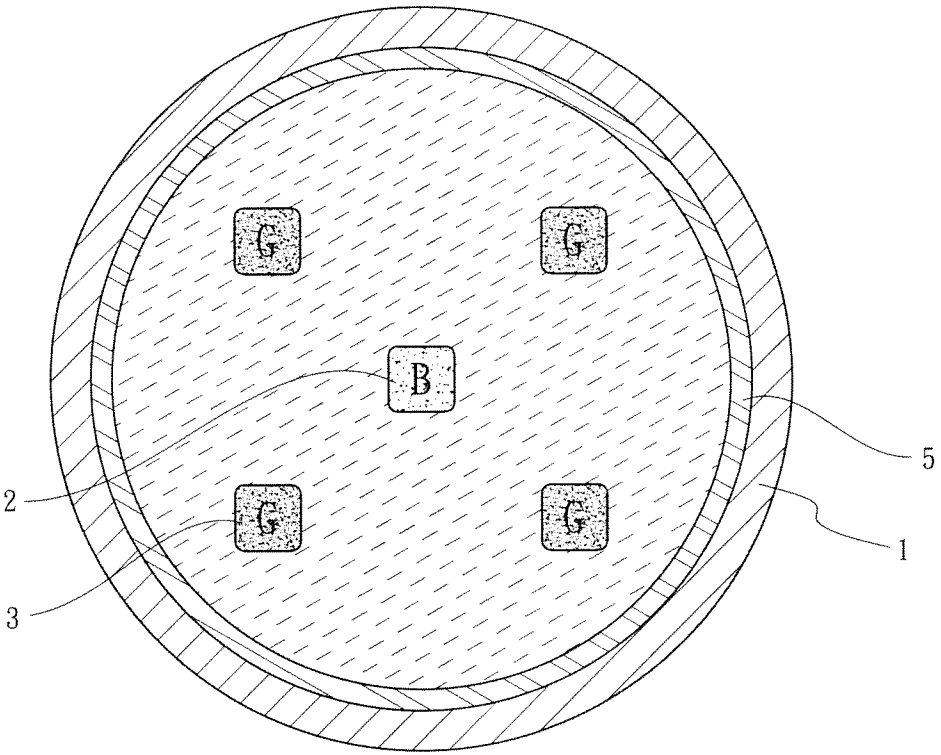

Referring to FIGS. 4-5, a first embodiment is described as following. The wavelength of each light beam from each main light chip 2 is 350 nm to 470 nm. The wavelength of each light beam from each sub light chip 3 is 480 nm to 570 nm. Each main light chip 2 is a blue LED. Each sub light chip 3 is a green LED. One main light chip 2 is positioned at a central portion of the base 1; four sub light chips 3 are positioned around the main light chip 2. The main light chip 2 and the sub light chips 3 are spaced from each other (the number of the main light chips 2 or the sub light chips 3 is not limited by the present invention.). Under this arrangement, when the ambient environment is bright, the controlling member 6 drives the luminance of each main light chip 2 to be higher than that of each sub light chip 3; when the ambient environment is dark, the controlling member 6 drives the luminance of each sub light chip 3 to be higher than that of each main light chip 2. Therefore, the present invention has a vision of a user clear when the ambient environment is dark, because a green light is friendly to the user when the ambient environment is dark.

Figure 6:
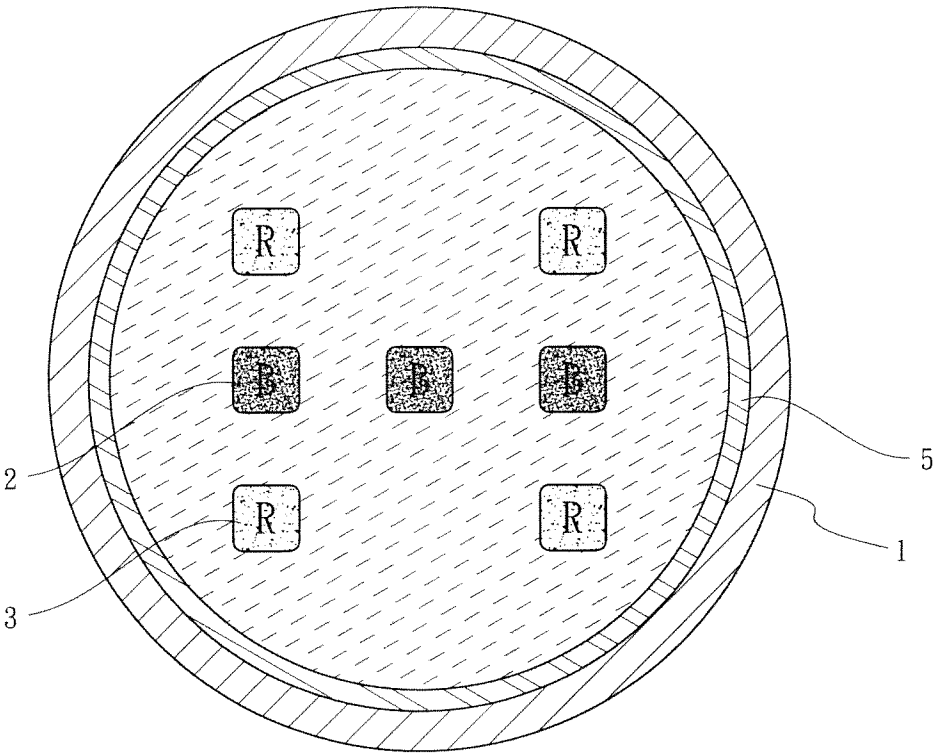
FIG. 6 is a perspective view of another embodiment of the present invention.

Referring to FIG. 6, a second embodiment is described as following. The wavelength of each light beam from each main light chip 2 is 350 nm to 470 nm. The wavelength of each light beam from each sub light chip 3 is 600 nm to 870 nm. Each main light chip 2 is a blue LED. Each sub light chip 3 is a red LED. The light beams from each main light chip 2 are mixed with the light beams from each sub light chip 3; in addition, a color rendition index of each mixed light beam is higher than that of each original light beam form each main light chip 2 or each sub light chip 3.

Figure 3:
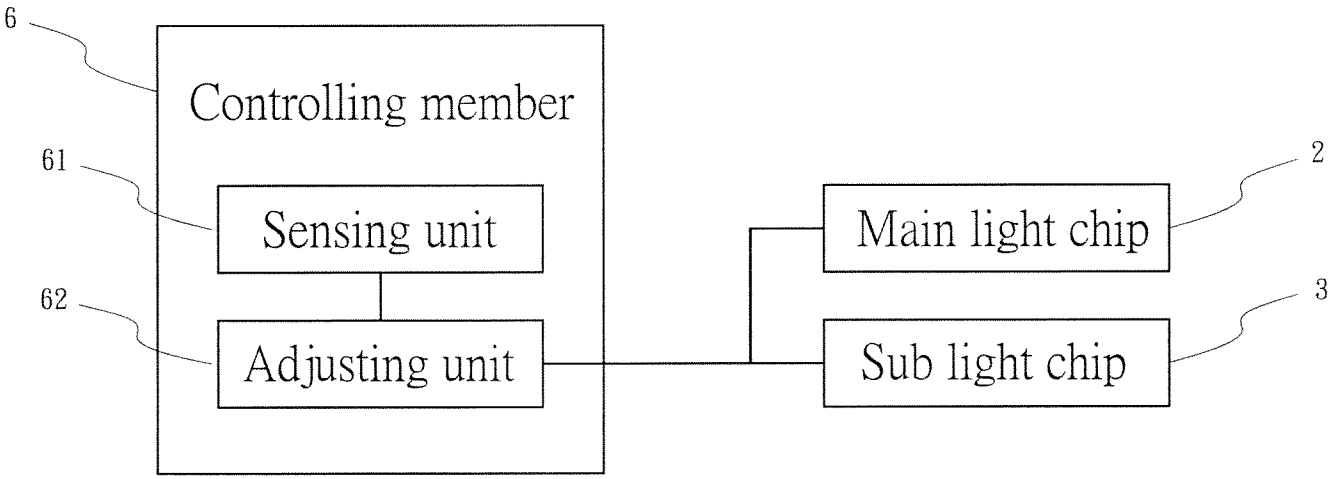
FIG. 3 a block chart for showing a controlling member.

Referring to FIG. 3, the controlling member 6 has a sensing unit 61 and an adjusting unit 62. The adjusting unit 62 is electrically connected to the sensing unit 61. The adjusting unit 62 is electrically connected to each main light chip 2 and each sub light chip 3. Under this arrangement, the sensing unit 61 senses that the ambient environment is bright or dark; thereafter, the sensing unit 61 sends a signal (not shown) to the adjusting unit 62; finally, the adjusting unit 62 controls the luminance of each main light chip 2 and the luminance of each sub light chip 3. Specially, when the controlling member 6 senses that an object (such as a person, a car, etc.) approaches the present invention, the controlling member 6 drives the luminance of each main light chip 2 to increase and drives the luminance of each sub light chip 3 to decrease; in contrast, when the controlling member 6 does not sense that the object approaches the present invention, the controlling member 6 drives the luminance of each main light chip 2 to decrease and drives the luminance of each sub light chip 3 to increase.

Furthermore, after the wavelength of each light beam from each main light chip 2 is shifted by the wavelength shifter 4, a color temperature of the present invention is 5500K to 7000K. The wavelength shifter 4 has a plurality of fluorescent powders (not shown). The fluorescent powders correspond to each main light chip 2. The fluorescent powders are yellow. The fluorescent powders can shift the wavelength of each light beam from each main light chip 2 so as to make a white color temperature. Each of the main light chip 2 and the sub light chip 3 is a watt-level chip.

Although the invention has been explained in relation to its preferred embodiment, it is to be understood that many other possible modifications and variations can be made without departing from the spirit and scope of the invention as hereinafter claimed.

What is claimed is:

1. A LED package structure comprising:

a base;

at least one main light chip assembled to the base;

a plurality of sub light chips assembled to the base;

a wavelength shifter assembled to the base, the wavelength shifter located above each main light chip and each sub light chip, the wavelength shifter configured to shift a wavelength of each light beam from each main light chip;

an outer lens assembled to the base and located above the wavelength shifter, so as to package each main light chip, each sub light chip and the wavelength shifter, the outer lens improving a light extraction efficiency of the light beams; and a controlling member electrically connected to each main light chip and each sub light chip, the controlling member configured to control luminance of each main light chip and luminance of each sub light chip according to an ambient environment.

2. The LED package structure as claimed in claim 1, wherein the wavelength of each light beam from each main light chip is 350 nm to 470 nm; the wavelength of each light beam from each sub light chip is 480 nm to 570 nm; each main light chip is a blue LED; each sub light chip is a green LED.

3. The LED package structure as claimed in claim 1, wherein the wavelength of each light beam from each main light chip is 350 nm to 470 nm; the wavelength of each light beam from each sub light chip is 600 nm to 870 nm; each main light chip is a blue LED; each sub light chip is a red LED; the light beams from each main light chip are mixed with the light beams from each sub light chip.

4. The LED package structure as claimed in claim 1, wherein after the wavelength of each light beam from each main light chip is shifted by the wavelength shifter, a color temperature of the LED package structure is 5500K to 7000K.

5. The LED package structure as claimed in claim 1, wherein the wavelength shifter has a plurality of fluorescent powders; the fluorescent powders correspond to each main light chip.

6. The LED package structure as claimed in claim 1, wherein the controlling member has a sensing unit and an adjusting unit which is electrically connected to the sensing unit; the adjusting unit is electrically connected to each main light chip and each sub light chip; the sensing unit is configured to sense the ambient environment and send a signal to the adjusting unit, so as to drive the adjusting unit to control the luminance of each main light chip and the luminance of each sub light chip.

7. The LED package structure as claimed in claim 1, wherein each of the main light chip and the sub light chip is a watt-level chip.

* * * * *